US006120205A

United States Patent [19]

Larson

[11] Patent Number: 6,120,205

[45] Date of Patent: Sep. 19, 2000

[54] WALL AND CEILING SCRAPING DEVICE WITH COLLECTION PAN

[76] Inventor: William Larson, 20148 Paseo Luis, Yorba Linda, Calif. 92886

[21] Appl. No.: 09/398,851

[22] Filed: Sep. 17, 1999

[51] Int. Cl.[7] ..... A47L 13/03

[52] U.S. Cl. ..... 401/261; 30/136; 15/236.01; 156/584

[58] Field of Search ..... 30/136, 136.5; 401/261, 263, 193; 15/236.01, 236.02, 236.04, 236.05, 236.06, 236.07, 236.08, 236.09; 156/584

[56] References Cited

U.S. PATENT DOCUMENTS

| | | | |
|---|---|---|---|
| 1,142,811 | 6/1915 | Griswold | 401/263 |
| 1,710,151 | 4/1929 | During | 30/136 |
| 2,726,314 | 12/1955 | Prain | 126/271.1 |
| 4,115,892 | 9/1978 | Stickler | 15/105 |
| 5,116,152 | 5/1992 | Caswell | 401/261 |
| 5,477,583 | 12/1995 | Deloe | 15/236.01 |

*Primary Examiner*—David J. Walczak
*Assistant Examiner*—Peter deVore
*Attorney, Agent, or Firm*—Goldstein R Canino

[57] ABSTRACT

A wall and ceiling scraping device with collection pan including a scraping blade having a generally rectangular configuration. The scraping blade is defined by a planar upper surface, a planar lower surface, a leading edge, a trailing edge, and opposed side edges. A collection pan is secured to the trailing edge of the scraping blade. A hose coupler is secured to the upper surface of the scraping blade adjacent to the trailing edge thereof. The hose coupler includes a planar plate secured to the scraping blade. The planar plate has a cylindrical tube extending outwardly therefrom in an angular orientation. The tube has an open outer end with internal threads for coupling with a standard water hose. An inner end of the tube has a pair of spray nozzles disposed therein directed towards the leading edge of the scraping blade.

4 Claims, 2 Drawing Sheets

FIG 3
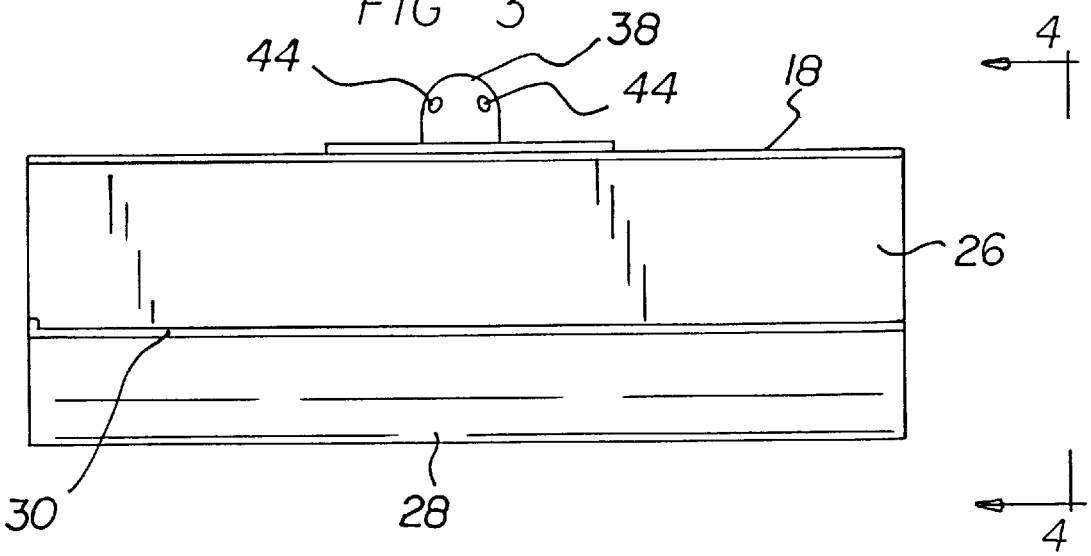
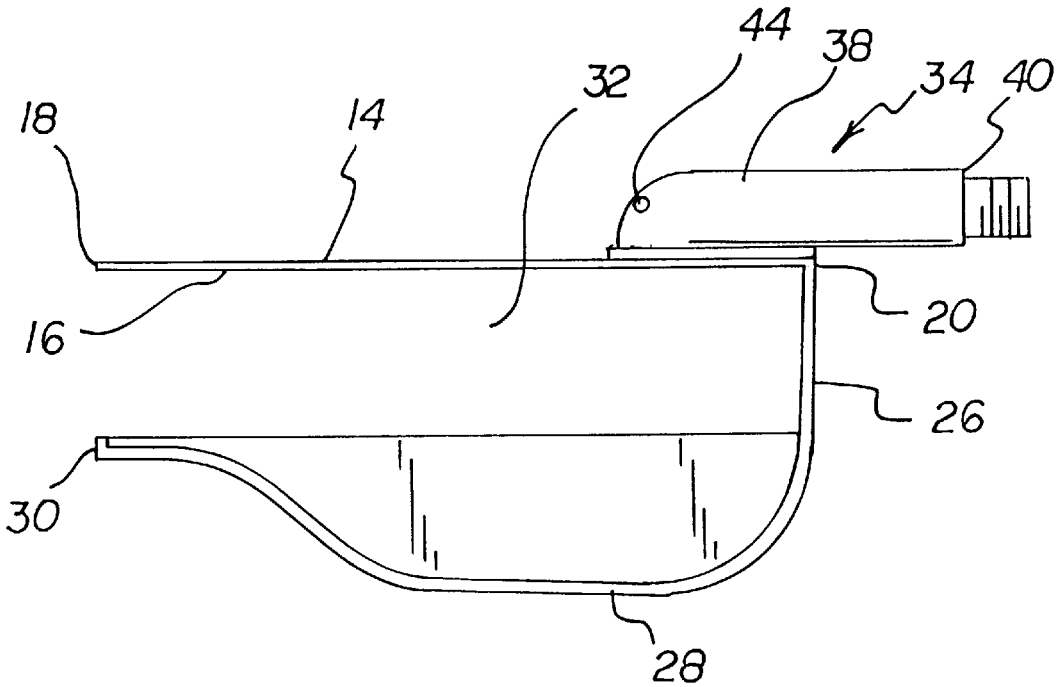
FIG 4

WALL AND CEILING SCRAPING DEVICE WITH COLLECTION PAN

BACKGROUND OF THE INVENTION

The present invention relates to a wall and ceiling scraping device with collection pan and more particularly pertains to scraping and collecting materials from a wall or ceiling surface so as to minimize clean-up.

The removal of wall coverings, such as wall paper, paint, ceiling plaster, or texture, usually involves the use of some type of scraping device that is directed into the wall or other surface in a scraping motion so as to facilitate it's removal. The unfortunate result of this removal is that the wall paper, paint, plaster, or texture falls to the floor and needs to be collected and discarded. What is needed is a method of scraping off such materials while at the same time collecting the removed materials so the worker will not have to clean up after or during the process.

The present invention attempts to solve the abovementioned problem by providing a device that has a scraping blade with a collection pan secured to the blade so that as the wall coverings are removed by the blade, they are collected in the pan for quick and easy disposal.

The use of scraping devices is known in the prior art. More specifically, scraping devices heretofore devised and utilized for the purpose of removing wall coverings are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a wall or ceiling scraping device with collection pan for scraping and collecting materials from a wall surface so as to minimize clean-up.

In this respect, the wall and ceiling scraping device with collection pan according to the present invention substantially departs from the conventional concepts and designs of the prior art, and in doing so provides an apparatus primarily developed for the purpose of scraping and collecting materials from a wall or ceiling surface so as to minimize clean-up.

Therefore, it can be appreciated that there exists a continuing need for a new and improved wall and ceiling scraping device with collection pan which can be used for scraping and collecting materials from a wall or ceiling surface so as to minimize clean-up. In this regard, the present invention substantially fulfills this need.

SUMMARY OF THE INVENTION

In the view of the foregoing disadvantages inherent in the known types of scraping devices now present in the prior art, the present invention provides an improved wall scraping device with collection pan. As such, the general purpose of the present invention, which will be described subsequently in greater detail, is to provide a new and improved wall and ceiling scraping device with collection pan and method which has all the advantages of the prior art and none of the disadvantages.

To attain this, the present invention essentially comprises a scraping blade having a generally rectangular configuration. The scraping blade is defined by a planar upper surface, a planar lower surface, a leading edge, a trailing edge, and opposed side edges. A collection pan is secured to the trailing edge of the scraping blade. The collection blade includes a rear wall extending downwardly from the trailing edge of the scraping blade. A bottom end of the rear wall has a curvilinear bottom wall extending forwardly therefrom. A forward edge of the curvilinear bottom wall is positioned below the leading edge of the scraping blade. A hose coupler is secured to the upper surface of the scraping blade adjacent to the trailing edge thereof. The hose coupler includes a planar plate secured to the scraping blade. The planar plate has a cylindrical tube extending outwardly therefrom in an angular orientation. The tube has an open outer end with internal threads for coupling with a standard water hose. An inner end of the tube has a pair of spray nozzles disposed therein directed towards the leading edge of the scraping blade. An extension rod is provided having a threaded lower end for coupling with the open outer end of the cylindrical tube of the hose coupler. The extension rod has an open outer end for coupling with a standard water hose.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wall and ceiling scraping device with collection pan which has all the advantages of the prior art scraping devices and none of the disadvantages.

It is another object of the present invention to provide a new and improved wall and ceiling scraping device with collection pan which may be easily and efficiently manufactured and marketed.

It is a further object of the present invention to provide a new and improved wall and ceiling scraping device with collection pan which is of durable and reliable construction.

An even further object of the present invention is to provide a new and improved wall and ceiling scraping device with collection pan which is susceptible of a low cost of manufacture with regard to both materials and labor, and which accordingly is then susceptible of low prices of sale to the consuming public, thereby making such a wall and ceiling scraping device with collection pan economically available to the buying public.

Even still another object of the present invention is to provide a new and improved wall and ceiling scraping device with collection pan for scraping and collecting materials from a wall surface so as to minimize clean-up.

Lastly, it is an object of the present invention to provide a new and improved wall and ceiling scraping device with collection pan including a scraping blade having a generally rectangular configuration. The scraping blade is defined by a planar upper surface, a planar lower surface, a leading edge, a trailing edge, and opposed side edges. A collection pan is secured to the trailing edge of the scraping blade. A hose coupler is secured to the upper surface of the scraping blade adjacent to the trailing edge thereof. The hose coupler includes a planar plate secured to the scraping blade. The planar plate has a cylindrical tube extending outwardly therefrom in an angular orientation. The tube has an open outer end with internal threads for coupling with a standard water hose. An inner end of the tube has a pair of spray nozzles disposed therein directed towards the leading edge of the scraping blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the present invention as taken along line 3—3 of FIG. 2.

FIG. 4 is a side elevation view of the present invention.

The same reference numerals refer to the same parts through the various figures.

DESCRIPTION OF THE PREFERRED EMBODIMENT

Figure 1:
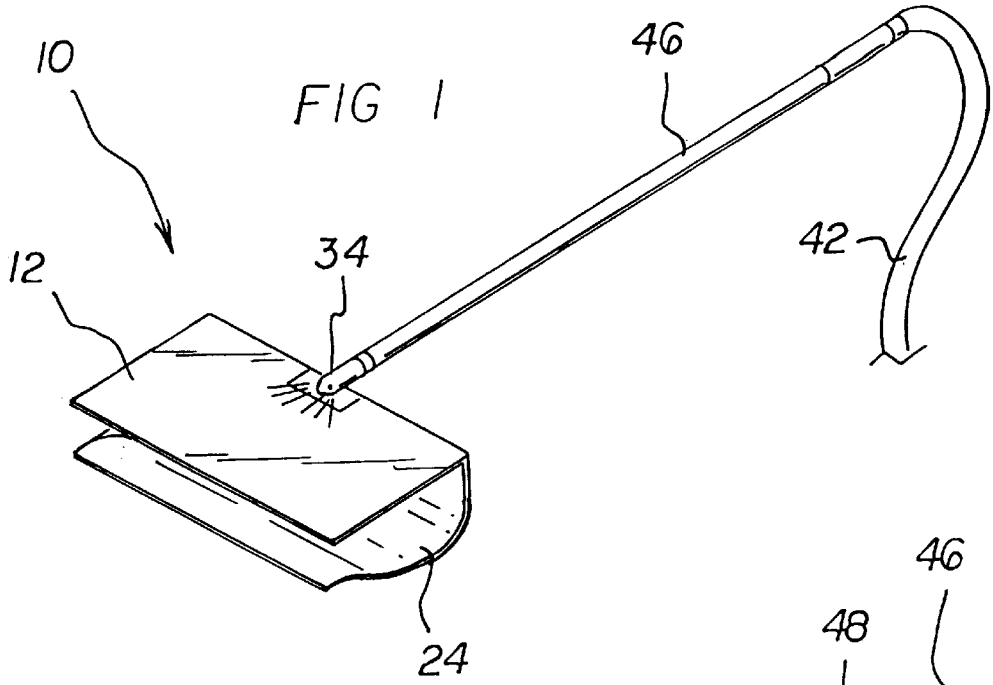
FIG. 1 is a perspective view of the preferred embodiment of the wall and ceiling scraping device with collection pan constructed in accordance with the principles of the present invention.
Figure 2:
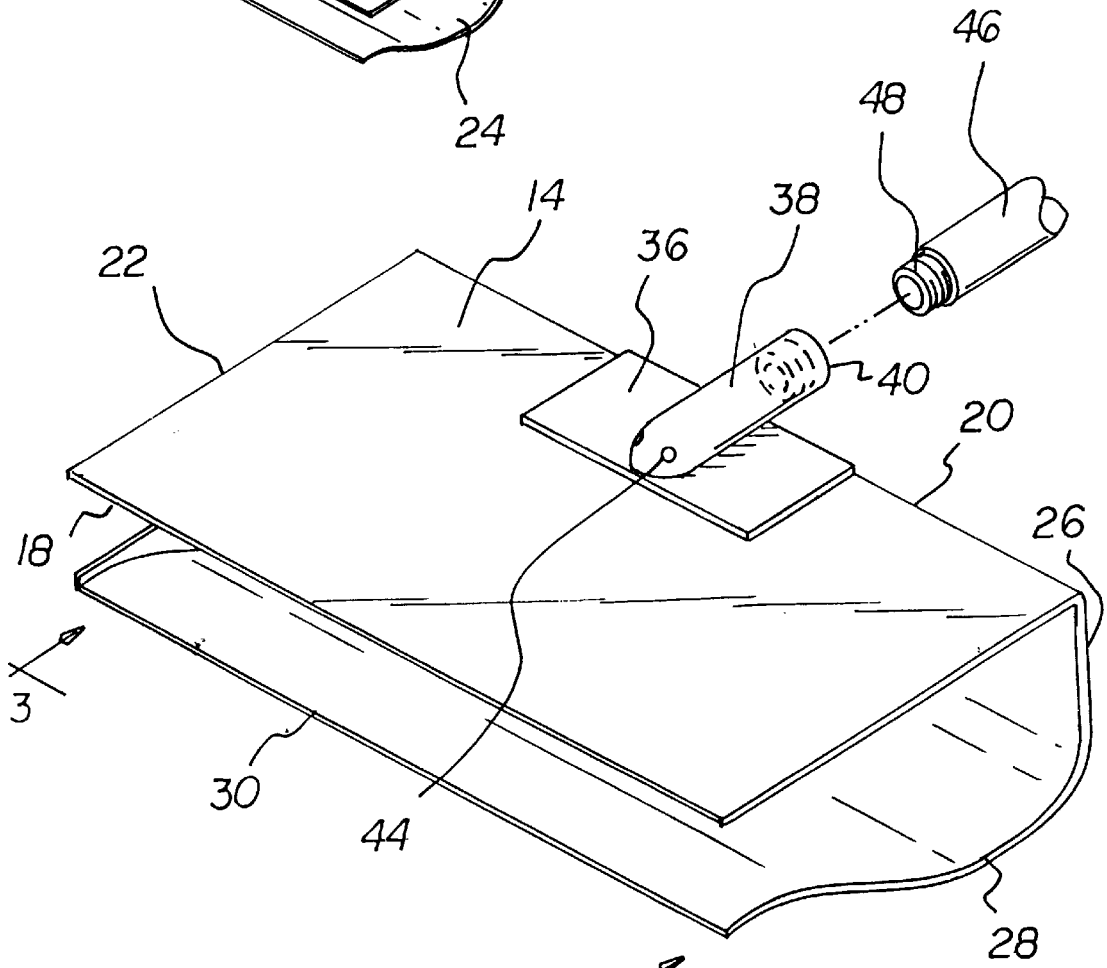
FIG. 2 is a perspective view of the present invention illustrating a hose being attached to the handle portion thereof.

With reference now to the drawings, and in particular, to FIGS. 1 through 4 thereof, the preferred embodiment of the new and improved wall scraping device with collection pan embodying the principles and concepts of the present invention and generally designated by the reference number 10 will be described.

Specifically, it will be noted in the various Figures that the device relates to a wall scraping device with collection pan for scraping and collecting materials from a wall surface so as to minimize clean-up. In its broadest context, the device consists of a scraping blade, a collection pan, a hose coupler, and an extension rod. Such components are individually configured and correlated with respect to each other so as to attain the desired objective.

The scraping blade 12 has a generally rectangular configuration. The scraping blade 12 is defined by a planar upper surface 14, a planar lower surface 16, a leading edge 18, a trailing edge 20, and opposed side edges 22.

The collection pan 24 is secured to the trailing edge 20 of the scraping blade 12. The collection pan 24 includes a rear wall 26 extending downwardly from the trailing edge 20 of the scraping blade 12. A bottom end of the rear wall 26 has a curvilinear bottom wall 28 extending forwardly therefrom. A forward edge 30 of the curvilinear bottom wall 28 is positioned below the leading edge 18 of the scraping blade 12. The positioning of the forward edge 30 and the leading edge 18 of the scraping blade 12 creates a channel 32 that will collect the removed wall coverings therein so that the removed coverings can gather on the curvilinear bottom wall 28 where after they may be properly disposed of in a garbage receptacle.

The hose coupler 34 is secured to the upper surface 14 of the scraping blade 12 adjacent to the trailing edge 20 thereof. The hose coupler 34 includes a planar plate 36 secured to the scraping blade 12. The planar plate 36 has a cylindrical tube 38 extending outwardly therefrom in an angular orientation. The tube 38 has an open outer end 40 with internal threads for coupling with a standard water hose 42. An inner end of the tube 38 has a pair of spray nozzles 44 disposed therein directed towards the leading edge 18 of the scraping blade 12. The hose coupler 34 allows for water to be sprayed onto the wall or other surface when removing the wall coverings.

The extension rod 46 has a threaded lower end 48 for coupling with the open outer end 40 of the cylindrical tube 38 of the hose coupler 34. The extension rod 46 has an open outer end for coupling with a standard water hose 42. The extension rod 42 is rigid so as to allow a person using the device 10 to reach wall coverings at upper points on a wall or on a ceiling.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wall and ceiling scraping device with collection pan for scraping and collecting materials from a wall surface so as to minimize clean-up comprising, in combination:

a scraping blade having a generally rectangular configuration, the scraping blade being defined by a planar upper surface, a planar lower surface, a leading edge, a trailing edge, and opposed side edges;

a collection pan secured to the trailing edge of the scraping blade, the collection pan including a rear wall extending downwardly from the trailing edge of the scraping blade, a bottom end of the rear wall having a curvilinear bottom wall extending forwardly therefrom, a forward edge of the curvilinear bottom wall being positioned below the leading edge of the scraping blade;

a hose coupler secured to the upper surface of the scraping blade adjacent to the trailing edge thereof, the hose coupler including a planar plate secured to the scraping blade, the planar plate having a cylindrical tube extending outwardly therefrom in an angular orientation, the tube having an open outer end with internal threads for coupling with a standard water hose, an inner end of the tube having a pair of spray nozzles disposed therein directed towards the leading edge of the scraping blade;

an extension rod having a threaded lower end for coupling with the open outer end of the cylindrical tube of the hose coupler, the extension rod having an open outer end for coupling with a standard water hose.

2. A wall and ceiling scraping device with collection pan for scraping and collecting materials from a wall surface so as to minimize clean-up comprising, in combination:

a scraping blade having a generally rectangular configuration, the scraping blade being defined by a planar upper surface, a planar lower surface, a leading edge, a trailing edge, and opposed side edges;

a collection pan secured to the trailing edge of the scraping blade and configured to collect the materials scraped from the wall by the scraping blade;

a hose coupler secured to the upper surface of the scraping blade adjacent to the trailing edge thereof, the hose coupler including a planar plate secured to the scraping blade, the planar plate having a cylindrical tube extending outwardly therefrom in an angular orientation, the tube having an open outer end with internal threads for coupling with a standard water hose, an inner end of the tube having a pair of spray nozzles disposed therein directed towards the leading edge of the scraping blade.

3. The wall and ceiling scraping device with collection pan as set forth in claim 2 wherein the collection pan including a rear wall extending downwardly from the trailing edge of the scraping blade, a bottom end of the rear wall having a curvilinear bottom wall extending forwardly therefrom, a forward edge of the curvilinear bottom wall being positioned below the leading edge of the scraping blade.

4. The wall and ceiling scraping device with collection pan as set forth in claim 2 and further including an extension rod having a threaded lower end for coupling with the open outer end of the cylindrical tube of the hose coupler, the extension rod having an open outer end for coupling with a standard water hose.

* * * * *